US010059573B2

(12) United States Patent
Van Keuren, II et al.

(10) Patent No.: US 10,059,573 B2
(45) Date of Patent: Aug. 28, 2018

(54) DOUBLE MOVABLE PULLEY LOAD BALANCING HOIST

(71) Applicant: Tri-Motion Industries, Inc., Tampa, FL (US)

(72) Inventors: Oliver W. Van Keuren, II, Tampa, FL (US); William J. Pinciaro, Tampa, FL (US)

(73) Assignee: Tri-Motion Industries, Inc., Tampa, FL (US)

( * ) Notice: Subject to any disclaimer, the term of this patent is extended or adjusted under 35 U.S.C. 154(b) by 775 days.

(21) Appl. No.: 14/269,916

(22) Filed: May 5, 2014

(65) Prior Publication Data

US 2015/0314999 A1 Nov. 5, 2015

(51) Int. Cl.
*B66D 3/18* (2006.01)

(52) U.S. Cl.
CPC ..... *B66D 3/18* (2013.01)

(58) Field of Classification Search
CPC ..... B66D 3/18; B66D 1/08; B66D 3/26
See application file for complete search history.

(56) References Cited

U.S. PATENT DOCUMENTS

| | | | | |
|---|---|---|---|---|
| 2,176,979 | A | 10/1939 | Platz | |
| 2,500,879 | A | 3/1950 | Smallpeice | |
| 2,613,903 | A | 10/1952 | Platz | |
| 3,669,411 | A | 6/1972 | McKendrick | |
| 3,675,899 | A | 7/1972 | McKendrick | |
| 3,773,296 | A | 11/1973 | McKendrick | |
| 3,998,432 | A | 12/1976 | Uldricks et al. | |
| 4,142,709 | A * | 3/1979 | Giessler | B66D 3/18 187/253 |
| 4,455,013 | A * | 6/1984 | Fischer | B66D 3/18 188/134 |
| 5,522,581 | A | 6/1996 | Kulhavy | |
| 5,553,832 | A | 9/1996 | Zaguroli, Jr. | |
| 5,984,276 | A | 11/1999 | Green | |

(Continued)

FOREIGN PATENT DOCUMENTS

| | | |
|---|---|---|
| CA | 2594269 | 1/2009 |
| DE | 8124068 | 3/1982 |

(Continued)

OTHER PUBLICATIONS

European Extended Search Report dated Aug. 11, 2015 for related European Application No. 14180104, 2 pgs.

*Primary Examiner* — Sang K Kim
*Assistant Examiner* — Nathaniel L Adams
(74) *Attorney, Agent, or Firm* — Fredrikson & Byron, P.A.

(57) ABSTRACT

A load-balancing device can be used to assist the lifting and lowering of heavy objects. In some examples, a load-balancing device includes a housing, a first movable pulley, a second movable pulley, a stationary pulley positioned between the first movable pulley and the second movable pulley, and a cable wound at least partially around the first movable pulley, the second movable pulley, and the stationary pulley. In operation, a pressurized control fluid may be introduced into a pressure chamber defined between the housing, the first movable pulley, and the second movable pulley. This can cause the first movable pulley and the second movable pulley to move away from the stationary pulley, withdrawing the cable into the housing and lifting a load attached to the cable.

16 Claims, 2 Drawing Sheets

(56) References Cited

U.S. PATENT DOCUMENTS

| | | | |
|---|---|---|---|
| 7,134,644 | B2 | 11/2006 | Wallner |
| 7,798,472 | B2 | 9/2010 | Vankeuren, II et al. |
| 8,465,005 | B2 | 6/2013 | Givens |

FOREIGN PATENT DOCUMENTS

| | | | |
|---|---|---|---|
| DE | 3133422 | | 3/1983 |
| EP | 2082985 | A1 | 7/2009 |
| GB | 675834 | A | 7/1952 |
| GB | 1563976 | | 4/1980 |
| GB | 1567271 | | 5/1980 |

* cited by examiner

DOUBLE MOVABLE PULLEY LOAD BALANCING HOIST

TECHNICAL FIELD

This disclosure relates to lifting assist devices and, more particularly, to lifting assist devices operated by pressurized control fluid.

BACKGROUND

Lifting assist devices, which may also be referred to as load balancing hoists, are used in a variety of industries to help operators manually position relatively heavy loads efficiently and ergonomically. For example, lift assist devices are used in airports to help baggage handlers move luggage between various conveyor lines and transport carts. Lift assist devices are also used in manufacturing assembly plants to help workers move and position components relative to a work piece being assembled. Although the structure of a lifting assist device can vary, typical designs utilize electrical or pneumatic power to raise and lower a hoisting cable to which a load is attached. In use, an operator will raise or lower the load using the lift assist device until the load is at a desired height. Once positioned, the lift assist device can counterbalance the weight of the load, leaving the load in a suspended position and permitting the operator to manually manipulate the load at the suspended height.

In some applications, lift assist devices are used with auxiliary lifting features, such as vacuum attachment connectors, that can quickly suction/attach a load to the lift assist device and release the load once positioned at a desired location. In these applications, a vacuum hose may extend from a vacuum source to the vacuum attachment connectors positioned at the end of the lift device. Since typical lift assist devices are not themselves weight balanced, they cannot be attached to swivel as an operator rotates around the lift assist device. As a result, during use when an operator rotates loads and moves around the lift assist device, the vacuum hose can become tangled with the lift device itself, necessitating work stoppage to untangle the vacuum hose from the lift assist device.

SUMMARY

In general, this disclosure is directed to load-balancing hoists having multiple pulleys that translate relative to a stationary center pulley. In some examples, the load-balancing hoist includes a housing containing first and second movable pulleys that are separated by a stationary pulley. The first and second movable pulleys may be contained within pistons that move within the housing and bound opposite end of the housing to create a pressure chamber enclosed by one or more walls of the housing and the pistons. In operation, a pressurized control fluid is introduced into the pressure chamber. The pressurized control fluid contacts the movable pulleys and/or pistons, pushing the movable pulleys away from the stationary pulley. When this occurs, a cable wound at least partially around the first movable pulley, the second movable pulley, and the stationary pulley can be drawn into the load-balancing hoist housing, lifting a load attached to a terminal end of the cable. When the pressurized control fluid is allowed to discharge from the pressure chamber, the movable pulleys can move back toward the stationary pulley, lowering the cable and/or the load attached to the terminal end of the cable.

Although the design of the load-balancing hoist can vary, in some examples, the hoist carries a single attachment member such as a hook substantially centered on the hoist and configured to attach to an overhead location. For example, the hoist may be attached using the single attachment member so that it is horizontally oriented and the first movable pulley and the second movable pulley are positioned to move substantially horizontally (e.g., parallel) with respect to ground. In use, the movable pulleys may each move at substantially the same rate and substantially the same distance relative to the stationary pulley. This can keep the center of mass of the load-balancing hoist substantially centered around the attachment member. As a result, if the end user desires to attach the load-balancing hoist to an overhead system via a swivel connection, it may do so without impacting the stability or usability of the hoist. In instances in which the load-balancing hoist is used with an auxiliary lifting feature, such as a vacuum attachment connection, the load-balancing hoist can swivel without tangling a corresponding vacuum hose.

In one example, a load-balancing device is described that includes a housing defining an interior chamber, a first movable pulley positioned within the interior chamber, a second movable pulley positioned within the interior chamber, a stationary pulley positioned between the first movable pulley and the second movable pulley within the interior chamber, and a cable wound at least partially around the first movable pulley, the second movable pulley, and the stationary pulley. The cable is configured to connect to a load to be lifted. The example specifies that the first movable pulley and the second movable pulley are configured to move away from the stationary pulley in response to a pressurized control fluid being introduced into the interior chamber, thereby lifting the load.

In another example, a load-balancing system is described that includes a load-balancing device and a pressurized fluid source. According to the example, the load-balancing device includes a housing defining a chamber containing a first piston, a second piston, and a stationary pulley-block. The first piston has a first pulley receiving cavity that contains a first movable pulley. The second piston has a second pulley receiving cavity that contains a second movable pulley. The stationary pulley-block contains a stationary pulley. The load-balancing device further includes a cable configured to connect to a load to be lifted that is wound at least partially around the first movable pulley, the second movable pulley, and the stationary pulley. According to the example, the pressurized fluid source is connected to the housing and configured to introduce pressurized control fluid into the chamber. The example specifies that the first movable pulley and the second movable pulley are configured to move away from the stationary pulley in response to the pressurized control fluid being introduced into the chamber, thereby lifting the load. The example also specifies that the first movable pulley and the second movable pulley are configured to move toward the stationary pulley in response to the pressurized control fluid exiting the chamber, thereby lowering the load.

In another example, a method is described that includes introducing a pressurized control fluid in a chamber of a load-balancing device, thereby causing a first movable pulley and a second movable pulley located inside of the chamber to move away from a stationary pulley also located inside of the chamber. The method includes, in response to the first movable pulley and the second movable pulley moving away from the stationary pulley, drawing a cable wound at least partially around the first movable pulley, the second movable pulley, and the stationary pulley into an interior of the pressure chamber, thereby lifting a load attached a terminal end of the cable.

The details of one or more examples are set forth in the accompanying drawings and the description below. Other features, objects, and advantages will be apparent from the description and drawings, and from the claims.

DETAILED DESCRIPTION

This disclosure generally relates to load-balancing hoists capable of lifting and/or lowering comparatively heavy loads and also holding the loads and at a desired elevation for an extended period of time (e.g., greater than 30 seconds, greater than 5 minutes, greater than 30 minutes). Although the load-balancing hoist can be used to lift lighter loads, such as those less than 10 pounds, in practice, the load-balancing hoist may find greater applicability lifting heavier loads. For example, the load-balancing hoist may lift loads greater than 20 pounds, such as greater than 50 pounds, greater than 250 pounds, or a load ranging from 50 pounds to 300 pounds. The load-balancing hoist can be used to lift any type of load including, for example, packaged goods, manufacturing components being assembled, luggage, mechanical parts being worked upon, and the like.

Although a load-balancing hoist in accordance with the disclosure can have different design features, in some examples, the hoist includes a pair of movable pulley blocks that are configured to translate relative to a stationary pulley block. The movable pulley blocks may each contain one or more pulleys and can form a piston that slides within a housing. The piston may act as a pressure barrier allowing for separate pressure conditions on each side of the piston. In use, an operator may control a pressurized fluid source to introduce pressurized fluid into a space separating the pair of movable pulley blocks. When the pressure inside of the load-balancing hoist is sufficient to overcome the weight of the load attached to the hoist, the pressure can push the pulley blocks in opposite directions away from each other and the stationary pulley block. When this occurs, a hoist cable connected to the movable pulley blocks and the stationary pulley block can be retracted inside of the load-balancing hoist, lifting a load attached at the external end of the cable. Releasing the pressure inside of the load-balancing hoist can allow the pulley blocks to move back toward each other and toward the stationary pulley block. This can extend the cable back out of the load-balancing hoist, lowering a load attached at the external end of the cable.

Figure 1:
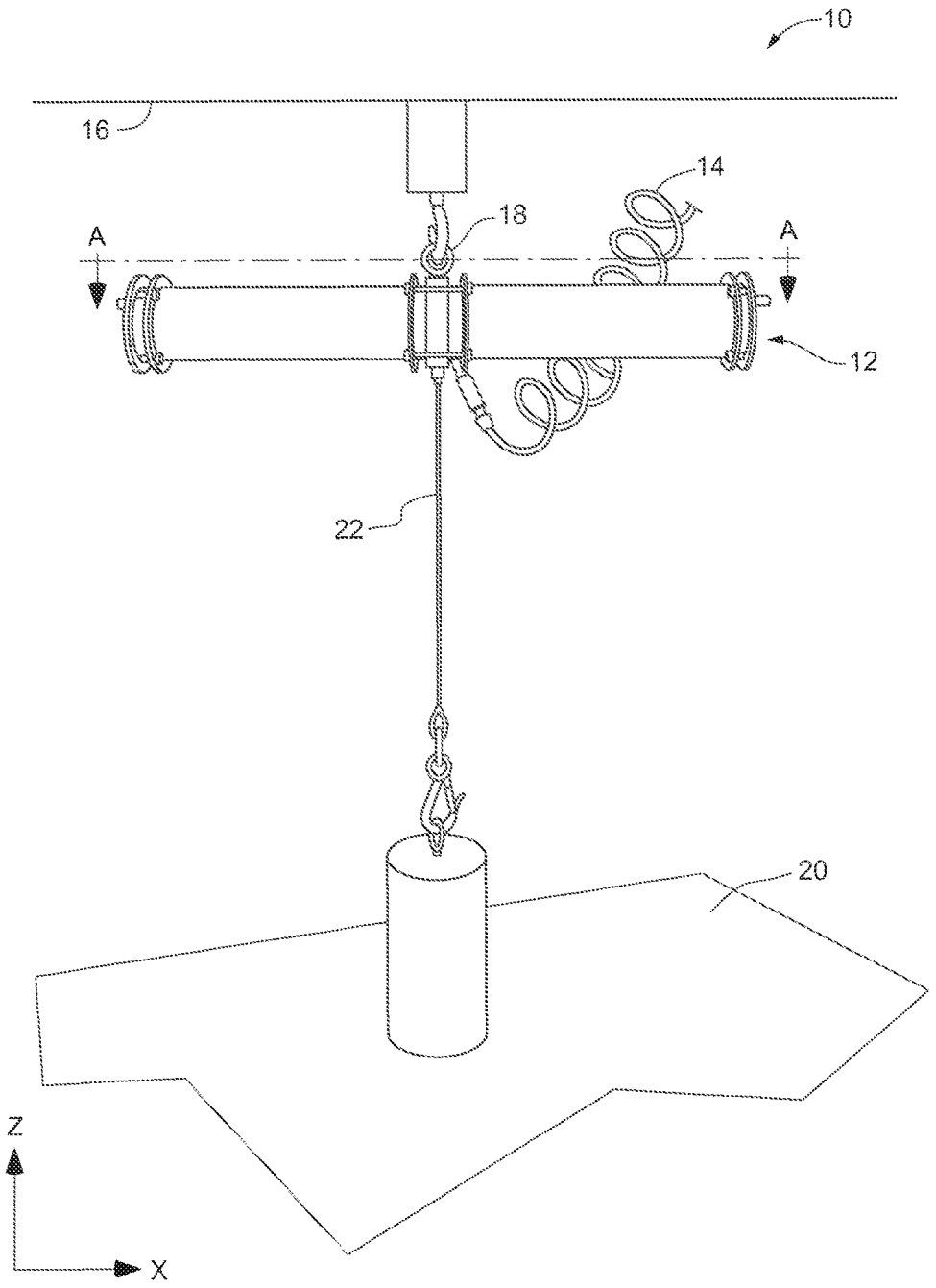
FIG. 1 is an illustration of an example load-balancing system that includes a load-balancing device and a pressurized fluid source.

FIG. 1 is an illustration of an example load-balancing system 10 that includes a load-balancing device 12 and a pressurized fluid source 14. Pressurized fluid source 14 is coupled to load-balancing device 12 and configured to introduce pressurized fluid into an interior of the device under the control of an operator. For example, an operator using load-balancing system 10 may control the rate and/or amount of pressurized fluid introduced into load-balancing device 12 to control the raising and lowering of a load connected to the device. In different examples, pressurized fluid source 14 may be a pressure pump, vacuum pump, or reservoir containing pressurized fluid. Pressurized fluid source 14 is typically configured to supply load-balancing device 12 with a gaseous pressurized fluid, such as pressurized air, although in other examples pressurized fluid source 14 may provide a liquid pressurized fluid, such as hydraulic fluid.

In the example of FIG. 1, load-balancing device 12 is attached at an overhead attachment location 16 via an attachment member 18. Overhead attachment location 16 is a vertically elevated location relative to load-balancing device 12. Overhead attachment location 16 may be an I-beam, a carriage assembly that moves along an overhead rail, a fixed ceiling surface, an arm extending outwardly from a vertical wall, or any other suitable attachment location. Attachment member 18 can provide a connection location for physically connecting load-balancing device 12 to overhead attachment location 16. In various examples, attachment member 18 may be a hook, a connecting pin, an opening to receive a hook or connecting pin (e.g., an eye bolt), a flexible connector (e.g., chain, cable, strap), or any other type of attachment member. Attachment member 18 may be fixed such that it does not move or rotate relative to the reminder load-balancing device 12. Alternatively, attachment member 18 may be configured to swivel, for example to allow 360 degree rotation of load-balancing device 12, and/or move relative to the remainder of the device. Load-balancing device 12 may be attached directly to overhead attachment location 16 via attachment member 18 or an intermediate connector (e.g., chain, cable) may be used to connect attachment member 18 to overhead attachment location 16. In such examples, the intermediate connector may or may not carry a swivel connection, for example to allow 360 degree rotation of load-balancing device 12.

Load-balancing device 12 in the example of FIG. 1 has only a single attachment member 18 providing a single connection location for connecting the device to overhead attachment location 16. Attachment member 18 is illustrated as being substantially centered along the major length of load-balancing device 12. In some examples, attachment member 18 is centered on load-balancing device 12 such that a substantially equal length of the device extends on either side of the member. In some additional examples, attachment member 18 is positioned at substantially the center of mass of load-balancing device 12.

Positioning attachment member 18 about the center of load-balancing device 12 may be useful to help keep the device horizontally oriented when in storage and/or when in operation. For example, load-balancing device 12 in FIG. 1 is illustrated as being positioned with its major length extending horizontally and being positioned generally parallel to ground 20. Such an orientation can help minimize the amount of overhead space occupied by load-balancing device 12. This can help keep an operator's overhead work space clear and help prevent the operator from inadvertently bumping their head into the device.

As described in greater detail, when load-balancing device 12 is oriented with its major axis extending substantially horizontally with respect to ground, movable pulleys within the device may be positioned to move substantially horizontally and parallel to ground. For example, the pulleys may be configured to move back and forth along the major length of load-balancing device 12 during operation, thereby moving along the direction of orientation of the device. While load-balancing device 12 is illustrated as being oriented horizontally with respect to ground, in other applications, the device may be positioned vertically with respect to ground. When so arranged, the major length of load-balancing device 12 may extend substantially orthogonally with respect to ground 20.

In load-balancing system 10, a hoist cable 22 extends downwardly from load-balancing device 12. Hoist cable 22 can retract (at least partially) up into an interior of load-balancing device 12 to raise a load attached at an end of the cable and extend (at least partially) out from the interior of the device to lower a load. In different examples, hoist cable 22 can be a rope, a metal cable (e.g., braided metal cable), a chain, or other type of cable of suitable strength to lift and/or lower a desired load. In one example, hoist cable 22 is a polymeric (e.g., nylon) coated cable. When used, the polymeric coating can help seal a pressure chamber established inside of load-balancing device 12 from the exterior environment.

Hoist cable 22 in the example of FIG. 1 extends out of load-balancing device 12 at a location substantially centered about the device housing. In particular, hoist cable 22 is illustrated as extending out of the housing of load-balancing device 12 at a location opposite attachment member 18. Such a location may be useful to transfer the weight of any load attached to hoist cable 22 through the housing of load-balancing device 12 and up into the attachment member. Such a location may also be useful to help keep load-balancing device 12 oriented horizontally with respect to ground, minimizing the overhead space occupied by the device. Hoist cable 22 may extend out of load-balancing device 12 at any suitable location along the device housing, and it should be appreciated that the disclosure is not limited in this respect.

Figure 2:
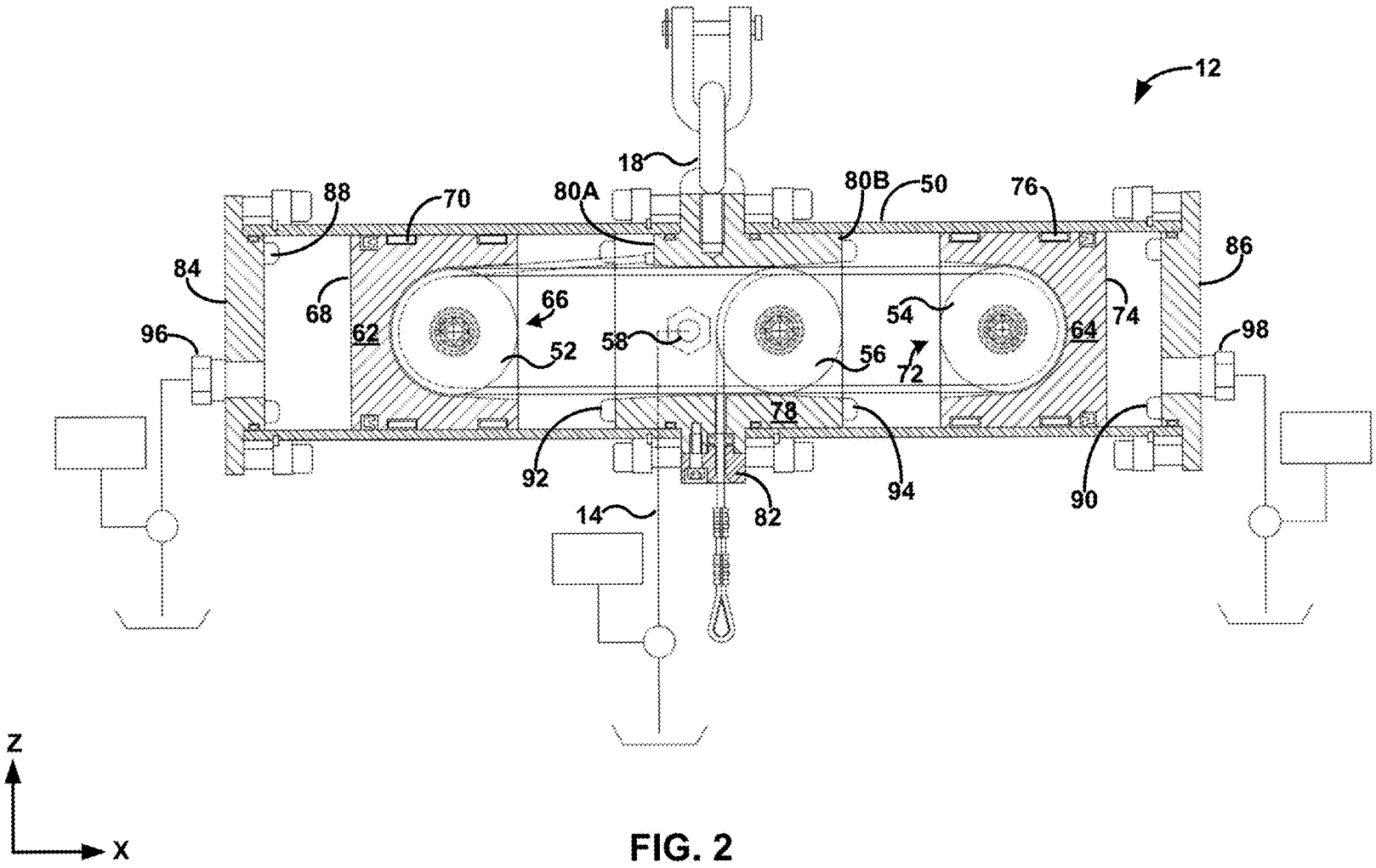
FIG. 2 is a cross-sectional illustration of an example load-balancing device taken along the A-A cross-section line indicated on FIG. 1.

FIG. 2 is a cross-sectional illustration of load-balancing device 12 taken along the A-A cross-section line indicated on FIG. 1. As shown in this example, load-balancing device 12 includes a housing 50 defining an interior chamber configured to receive a pressurized control fluid. Load-balancing device 12 also includes a first movable pulley 52, a second movable pulley 54, and a stationary pulley 56. Stationary pulley 56 is positioned between first movable pulley 52 and second movable pulley 54. In addition, a control fluid inlet 58 is located between first movable pulley 52 and second movable pulley 54 and configured to be connected to pressurized fluid source 14.

In operation, a pressurized control fluid from pressurized fluid source 14 is introduced into the space between first movable pulley 52 and second movable pulley 54. When pressure building inside of housing 50 generates a force sufficient to overcome the weight of the load attached to cable 22, first movable pulley 52 and second movable pulley 54 move away from stationary pulley 56. In particular, in the configuration of FIG. 2, first movable pulley 52 moves in the negative X-direction indicated on FIG. 2 and second movable pulley 54 moves in the positive X-direction. Stationary pulley 56 can remain in a fixed (e.g., non-moving) position as first movable pulley 52 and second movable pulley 54 move away from each other. Cable 22 is drawn further into housing 50 of load-balancing device 12 as first movable pulley 52 and second movable pulley 54 move away from each other, thereby lifting an object attached to the cable. The vertical elevation to which a load is lifted can be dictated by the extent of travel of first movable pulley 52 and second movable pulley 54. For example, maximum lift may be achieved when first movable pulley 52 and second movable pulley 54 are moved to the furthest separation distance permitted within housing 50.

To lower a load attached to cable 22, pressurized control fluid may be discharged from the space between first movable pulley 52 and second movable pulley 54. As the weight of the load attached to cable 22 overcomes the force generated by pressure inside of housing 50, first movable pulley 52 and second movable pulley 54 move toward stationary pulley 56. In particular, in the configuration of FIG. 2, first movable pulley 52 moves in the positive X-directed indicated on FIG. 2 and second movable pulley 54 moves in the negative X-direction. Cable 22 is extended farther out of housing 50 of load-balancing device 12 as first movable pulley 52 and second movable pulley 54 move toward each other, thereby lowering an object attached to the cable. The vertical elevation to which a load is lowered can be dictated by the extent of travel of first movable pulley 52 and second movable pulley 54.

Components described as being a pulley, including first movable pulley 52, second movable pulley 54, and stationary pulley 56 may be implemented using any type of pulley structure. In general, each pulley may be a wheel (e.g., circular, elliptical, eccentric) with a grooved rim around which a cord passes. For example, cable 22 may wrap at least partially (e.g., at least 45 degrees, at least 90 degrees) around the perimeter of each pulley, causing the cable to change direction as it wraps around the pulley. Each pulley may rotate as a load is raised or lowered using load-balancing device 12.

Although first movable pulley 52, second movable pulley 54, and stationary pulley 56 are each illustrated in FIG. 2 as being a single pulley, in practice, each of first movable pulley 52, second movable pulley 54, and/or stationary pulley 56 may be a block of multiple pulleys. When so configured, the pulleys within each block can be positioned in side-by-side alignment extending across the width of housing 50. For example, the pulleys may each be attached to a common axle extending across the block and each allowed to rotate independently around the axle. Cable 22 may extend back and forth between adjacent pulleys within a block of first movable pulleys and a block of second movable pulleys before extending over a single stationary pulley 56 that transitions the direction of the cable. In various examples, first movable pulley 52 and second movable pulley 54 may each be implemented as a single pulley or a block of multiple pulleys (e.g., two, three, four, five, six, or more pulleys).

To help pressure isolate an interior of housing 50 from an exterior environment while also allowing first movable pulley 52 and second movable pulley 54 to move within the housing, the first movable pulley and second movable pulley may each be attached to pistons. In the configuration of FIG. 2, load-balancing device 12 includes first piston 62 and second piston 64. First movable pulley 52 may be physically connected to first piston 62 such that the first movable pulley and first piston translate together as a piston-pulley assembly. Similarly, second movable pulley 54 may be physically connected to second piston 64 such that the second movable pulley and second piston also translate together as a piston-pulley assembly.

First piston 62 and second piston 64 may each form a sliding piece moved by or against fluid pressure. For example, in instances in which housing 50 is a cylinder with a circular cross-sectional shape, first piston 62 and second piston 64 may each be a cylinder or disk that fits snugly into the housing and is configured to move back and forth under changing fluid pressure inside of the housing. First piston 62 and second piston 64 may each help pressure isolate an interior of housing 50 from an ambient pressure (e.g., atmospheric pressure) surrounding load-balancing device 12. For example, first piston 62 and second piston 64 may bound opposed ends of a pressure chamber defined collectively by the sidewall(s) of housing 50, first piston 62, and second piston 64. The pressure chamber may receive and hold pressurized control fluid via control fluid inlet 58. For example, as first movable pulley 52 and second movable pulley 54 move to lift or lower a load, first piston 62 and second piston 64 can move with the movable pulleys, causing the pressure chamber to expand or contract in internal volume.

First piston 62 and second piston 64 can have any suitable size and shape. In the example of FIG. 2, first piston 62 defines a cavity 66 configured (e.g., sized and/or shaped) to receive and hold first movable pulley 52. Cavity 66 provides an open end of first piston 62 into which first movable pulley 52 is inserted. The open end of first piston 62 faces stationary pulley 56. Cable 22 extends into first piston 62 through the open end of the piston, around first movable pulley 52, and back out of the piston. In some examples, first piston 62 defines a closed terminal end 68 opposite the open end of the pulley. In addition, first piston 62 may have one or more seals or gaskets 70 extending around its exterior perimeter. First piston 62 may be gas tight such that pressurized control fluid introduced into housing 50 via control fluid inlet 58 can press against the first piston but not bypass the piston.

Second piston 64 in FIG. 2 provides a structure similar to the structure of first piston 62. Specifically, in the illustrated example, second piston 64 defines a cavity 72 configured to receive and hold second movable pulley 54. Cavity 72 provides an open end of second piston 64 into which second movable pulley 54 is inserted. The open end of second piston 64 faces stationary pulley 56. Cable 22 extends into second piston 64 through the open end of the piston, around second movable pulley 54, and back out of the piston. In some examples, second piston 64 defines a closed terminal end 74 opposite the open end of the pulley. In addition, second piston 64 may have one or more seals or gaskets 76 extending around its exterior perimeter. Second piston 64 may be gas tight such that pressurized control fluid introduced into housing 50 via control fluid inlet 58 can press against the second piston but not bypass the piston.

In operation, pressurized control fluid entering housing 50 acts on first piston 62 and second piston 64, causing the pistons to translate linearly away from each other to lift a load attached to cable 22. Conversely, when pressurized control fluid is discharged from housing 50, for example to reduce the pressure within the housing back down to atmospheric pressure, first piston 62 and second piston 64 can translate linearly toward each other to lower a load attached to cable 22. In some examples, first movable pulley 52, second movable pulley 54, and/or stationary pulley 56 are positioned inside of housing 50 so that the pulleys do not contact each other when moved to locations of closest proximity. This can prevent the pulleys from banging into each other and cable 22 from inadvertently slipping off of a pulley during operation of load-balancing device 12.

In the example of FIG. 2, cavity 66 of first piston 62 and cavity 72 of second piston 64 are sized such that first movable pulley 52 and second movable pulley 54 are positioned entirely within a respective piston cavity. For example, first movable pulley 52 and second movable pulley 54 may be positioned within a respective piston cavity such that no portion of the pulley extends beyond an end face of the piston. When so configured, the end face of each piston may contact a corresponding abutment structure of stationary pulley 56 (e.g., an end face of a stationary pulley block) prior to either the first movable pulley 52 or the second movable pulley 54 contacting the stationary pulley. This can help prevent damage to load-balancing device 12 during operation.

Load-balancing device 12 includes stationary pulley 56. Stationary pulley 56 is positioned between first movable pulley 52 and second movable pulley 54. Stationary pulley 56 may be positioned to direct cable 22 from a direction that is parallel to the major length of housing 50 to a direction that is substantially perpendicular to the major length. For example, stationary pulley 56 may receive a length of cable and redirect the cable approximately 90 degrees, e.g., by having the cable wrap partially around the pulley. This may be useful to redirect the direction of lifting and/or lowing force generated by load-balancing device 12 from being generally parallel to ground, when the major axis of the device is oriented generally parallel to ground, to being generally perpendicular to ground.

To hold stationary pulley 56 in a fixed physical position inside of housing 50, load-bearing device 12 may include stationary pulley block 78. Stationary pulley block 78 may be a block or casing located inside of housing 50 to which stationary pulley 56 is mounted. Stationary pulley block 78 can hold stationary pulley 56 in a non-moving position as first piston 62 and second piston 64 translate back and forth inside of housing 50. In some examples, including the example of FIG. 2, the end faces 80A and 80B of stationary pulley block 78 extend beyond stationary pulley 56. End faces 80A and 80B of stationary pulley block 78 may be configured to contact corresponding end faces of first piston 62 and second piston 64, respectively, e.g., when cable 22 is lowered to its lowermost position and first piston 62 and second piston 64 are in closest proximity to stationary pulley block 78. In other examples, load-balancing device 12 may not include stationary pulley block 78. Instead, stationary pulley 56 may be mounted on an axial attached directly to the sidewall(s) of housing 50.

Hoist cable 22 is configured to connect to a load to be height adjusted. Cable 22 may extend from an anchored end that does not change height during operation of load-balancing device 12 to a terminal or free end configured to connect to a load, e.g., either directly or indirectly via an intermediate connection member. Cable 22 passes and wraps at least partially about first movable pulley 52, second movable pulley 54, and stationary pulley 56 as it passes from the anchored end to the free end. In the example of FIG. 2, cable 22 is connected (e.g., anchored) to stationary pulley block 78 and extends at least partially around first movable pulley 52 followed by second movable pulley 54 and then stationary pulley 56. In other examples, cable 22 may be anchored at a different location inside of housing 50 or even outside of the housing.

As discussed previously, housing 50 can define an enclosed chamber configured to receive a pressurized control fluid and hold an elevated pressure inside of load-balancing device 12. To help maintain a non-atmospheric pressure inside of housing 50, load-balancing device 12 may include a seal 82 sealing the housing in the region of cable 22. Seal 82 may extend around cable 22 and seal closed the perimeter of an opening in housing 50 through which cable 22 extends. Seal 82 may help maintain a non-atmospheric pressure inside of housing 50 in the region between first movable pulley 52 and second movable pulley 54.

To further enclose housing 50 of load-balancing device 12, the housing may include a first end cap 84 closing a first end of the housing and a second end cap 86 closing a second end of the housing. First end cap 84 and/or second end cap 86 may be removable from housing 50, e.g., to facilitate access to an interior of load-balancing device 12 for servicing the device. Alternatively, first end cap 84 and/or second end cap 86 may be permanently attached to housing 50, e.g., by being welded, cast, or otherwise permanently attached to housing 50. In some examples, the space between first end cap 84 and first piston 62 may be configured to hold a non-atmospheric pressure and the space between second end cap 86 and second piston 64 may also be configured to hold a non-atmospheric pressure. In these examples, housing 50 may define three different pressure chambers: one between first end cap 84 and first piston 62, one between first piston 62 and second piston 64, and one between second piston 64 and second end cap 86. In other examples, the space between first end cap 84 and first piston 62 and/or second end cap 86 and second piston 64 may be at atmospheric pressure.

When configured as shown in FIG. 2, first piston 62 is configured to translate between first end cap 84 and stationary pulley block 78 inside of housing 50, and second piston 64 is configured to translate between second end cap 86 and the stationary pulley block. In particular, first piston 62 is configured to translate until positioned adjacent to and in contact with one or more bumpers 88 of first end cap 84, when lifting a load to a maximum vertically elevated position. Second piston 64 is also configured to translate until positioned adjacent to and in contact with one or more bumpers 90 of second end cap 86, when lifting a load to a maximum vertically elevated position. When lowering a load to a minimum vertically elevated position, first piston 62 and second piston 64 are configured to translate until positioned adjacent to and in contact with one or more bumpers 92, 94 of stationary pulley block 78, respectively.

In some examples, first piston 62 and second piston 64 are configured to translate at substantially the same rate and substantially the same distance in response to pressurized control fluid entering or exiting housing 50. In other examples, first piston 62 and second piston 64 may translate at different rates and/or different distances in response to a pressurized control fluid entering or exiting housing 50. First piston 62 and second piston 64 may translate at different rates and/or different distances if, for example, the pistons experience different frictional resistance.

To lower cable 22 from one vertical elevation to a lower vertical elevation, a pressurized control fluid previously introduced into housing 50 may be discharged from the housing. In some examples, the pressurized control fluid is withdrawn from housing 50, e.g., by pulling a vacuum through control fluid inlet 58 to draw the pressurized control fluid out of the housing. In other examples, control fluid inlet 58 is opened to atmospheric pressure, allowing the pressurized control fluid to discharge through the inlet and the pressure inside of housing 50 to equilibrate with atmospheric pressure.

In some examples, first end cap 84 includes a first valve 96 to control the pressure between first piston 62 and the first end cap. Similarly, second end cap 86 may include a second valve 98 to control the pressure between second piston 64 and the second end cap. First valve 96 and second valve 98 may open to atmospheric pressure when first piston 62 and second piston 64 translate back and forth within housing 50. This may release positive pressure that would otherwise build as the pistons translate toward the end caps and/or vacuum pressure that would otherwise build as the pistons translate toward stationary pulley block 78.

In other examples, a pressure source may be connected to first valve 96 and/or second valve 98. The pressure source may be a positive pressure source and/or a negative (vacuum) pressure source, relative to atmospheric pressure. When a negative pressure source is connected to first valve 96 and second valve 98, a vacuum may be generated between the pistons and end caps, helping to pull the pistons outward to lift a load attached to cable 22. When a positive pressure source is connected to first valve 96 and second valve 98, a positive pressure may be generated between the pistons and the end caps, helping to push the pistons toward stationary piston block 78 to lower cable 22. Depending on the design, load-balancing device 12 may be driven by applying and withdrawing pressure between the pistons and end caps without delivering pressurized control fluid between the pistons.

Load-balancing device 12 can be used to lift or lower a variety of different loads and then hold the loads at a desired vertically elevated position for a period of time sufficient for a worker to manipulate the loads. Load-balancing device 12 may provide quick and smooth lifting or lowing, allowing multiple loads to be height adjusted in rapid succession without disrupting the contents of the loads.

Various examples have been described. These and other examples are within the scope of the following claims.

The invention claimed is:

1. A load-balancing system comprising:

a load-balancing device that includes a housing defining a chamber containing a first piston, a second piston, and a stationary pulley-block, the first piston having a first pulley receiving cavity that contains a first movable pulley, the second piston having a second pulley receiving cavity that contains a second movable pulley, and the stationary pulley-block containing a stationary pulley, the first piston and the second piston bounding opposed ends of a pressure chamber, thereby providing a shared pressure environment acting on the first piston and the second piston and being pressure isolated from an ambient pressure environment surrounding housing, the load-balancing device further including a cable configured to connect to a load to be lifted that is wound at least partially around the first movable pulley, the second movable pulley, and the stationary pulley within the pressure chamber and exiting the housing through a sealed opening; and a pressurized fluid source connected to the housing and configured to introduce pressurized control fluid into the pressure chamber, wherein the first piston with first movable pulley contained therein and the second piston with second movable pulley contained therein are configured to move away from the stationary pulley in response to the pressurized control fluid being introduced into the shared pressure environment of the pressure chamber, thereby lifting the load, and the first movable pulley and the second movable pulley are configured to move toward the stationary pulley in response to the pressurized control fluid exiting the pressure chamber, thereby lowering the load.

2. The system of claim 1, wherein the first piston and second piston are configured to translate at substantially the same rate and substantially the same distance in response to the pressurized control fluid exiting the pressure chamber or being introduced into the pressure chamber.

3. The system of claim 1, wherein the pressurized fluid source comprises air.

4. The system of claim 1, further comprising an overhead attachment location, wherein the load-balancing hoist is attached to the overhead attachment location via a single attachment member substantially centered about the housing, the housing is oriented horizontally such that the first movable pulley and the second movable pulley are each configured to move parallel to ground, and the cable extends downwardly from the housing at a location substantially centered about the housing and opposite the single attachment member.

5. The system of claim 1, further comprising an inlet into the housing within a region of the stationary pulley-block to place the pressurized fluid source in fluid communication with the pressure chamber.

6. A load-balancing device comprising:

a housing defining an interior chamber;

a first movable pulley positioned within the interior chamber;

a second movable pulley positioned within the interior chamber;

a first piston located within the interior chamber and having a first pulley receiving cavity that contains the first movable pulley;

a second piston located within the interior chamber and having a second pulley receiving cavity that contains the second movable pulley;

a stationary pulley positioned between the first movable pulley and the second movable pulley within the interior chamber; and a cable wound at least partially around the first movable pulley, the second movable pulley, and the stationary pulley, the cable being configured to connect to a load to be lifted, wherein the first piston and the second piston bound opposed ends of a pressure chamber that is configured to receive pressurized control fluid, thereby providing a shared pressure environment acting on the first piston and the second piston and being pressure isolated from an ambient pressure environment surrounding housing, wherein the cable is wound at least partially around the first movable pulley, the second movable pulley, and the stationary pulley within the pressure chamber and exits the housing through a sealed opening, and wherein the first piston with first movable pulley contained therein and the second piston with second movable pulley contained therein are configured to move away from the stationary pulley in response to the pressurized control fluid being introduced into the shared pressure environment of the pressure chamber, thereby lifting the load.

7. The device of claim 6, wherein the first piston and second piston are configured to translate at substantially the same rate and substantially the same distance in response to the pressurized control fluid being introduced into the pressure chamber.

8. The device of claim 6, wherein the first movable pulley and the second movable pulley are configured to move toward the stationary pulley in response to the pressurized control fluid exiting the interior chamber, thereby lowering the load.

9. The device of claim 6, wherein the housing is configured to be oriented horizontally such that the first movable pulley and the second movable pulley are each configured to move parallel to ground.

10. The device of claim 6, further comprising an inlet into the housing configured to supply the pressurized fluid to the pressure chamber.

11. The device of claim 6, wherein the housing has a single attachment member substantially centered about the housing and configured to attach the housing to an overhead attachment location.

12. The device of claim 11, wherein the cable extends downwardly from the housing at a location substantially centered about the housing and opposite the single attachment member.

13. The device of claim 6, further comprising a stationary pulley block containing the stationary pulley, and wherein the housing further comprises a first end cap and a second end cap, the first piston being configured to translate between the stationary pulley block and the first end cap, and the second piston being configured to translate between the stationary pulley block and the second end cap.

14. The device of claim 13, wherein the first end cap contains a first valve and the second end cap contains a second valve, the first valve being configured to control pressure within the housing between the first end cap and the first piston, and the second valve being configured to control pressure within the housing between the second end cap and the second piston.

15. The device of claim 13, wherein the first piston defines a closed end facing the first end cap and an open end containing the first pulley and facing the stationary pulley block, the second piston defines a closed end facing the second end cap and an open end containing the second pulley and facing the stationary pulley block, and wherein the first and second pulleys are recessed relative to the open ends of the first and second pistons such that pistons are configured to contact the stationary pulley block without either the first pulley or the second pulley contacting the stationary pulley.

16. The device of claim 13, wherein cable is connected at one end to the stationary pulley block and extends at least partially around the first movable pulley followed by the second movable pulley and then the stationary pulley.

* * * * *